US012460873B2

(12) United States Patent
Lawless

(10) Patent No.: US 12,460,873 B2
(45) Date of Patent: Nov. 4, 2025

(54) HEAT EXCHANGER, PLATE ELEMENT THEREFOR, AND METHOD OF CONSTRUCTION

(71) Applicant: Rygan Corp., Broken Arrow, OK (US)

(72) Inventor: Lane Lawless, Tulsa, OK (US)

(73) Assignee: RYGAN CORP., Broken Arrow, OK (US)

( * ) Notice: Subject to any disclaimer, the term of this patent is extended or adjusted under 35 U.S.C. 154(b) by 147 days.

(21) Appl. No.: 18/481,688

(22) Filed: Oct. 5, 2023

(65) Prior Publication Data

US 2025/0116468 A1 Apr. 10, 2025

(51) Int. Cl.

| | |
|---|---|
| ***F28F 9/12*** | (2006.01) |
| ***F28D 9/00*** | (2006.01) |
| ***F28F 3/10*** | (2006.01) |
| ***F28F 3/12*** | (2006.01) |

(52) U.S. Cl.

CPC ..... *F28D 9/0068* (2013.01); *F28F 3/10* (2013.01); *F28F 3/12* (2013.01); *F28F 2230/00* (2013.01); *F28F 2265/12* (2013.01); *F28F 2275/20* (2013.01)

(58) Field of Classification Search

CPC ..... F28F 3/083; F28F 3/10; F28F 3/12; F28D 1/0213; F28D 1/035

See application file for complete search history.

(56) References Cited

U.S. PATENT DOCUMENTS

| | | | | |
|---|---|---|---|---|
| 1,833,664 | A * | 11/1931 | Vandegrift | F28F 3/12 165/157 |
| 1,961,660 | A | 6/1934 | Fehrmann | |
| 3,334,399 | A | 8/1967 | Teeguarden | |
| 4,499,942 | A | 2/1985 | Allison | |
| 5,359,989 | A | 11/1994 | Chase et al. | |
| 5,509,468 | A | 4/1996 | Lopez | |
| 7,093,649 | B2 | 8/2006 | Dawson | |
| 9,832,913 | B2 | 11/2017 | Shedd | |
| 2001/0030042 | A1 | 10/2001 | Davidian | |
| 2004/0099712 | A1 | 5/2004 | Tonkovich | |
| 2011/0079375 | A1 | 4/2011 | Nagurny | |
| 2011/0097244 | A1 | 4/2011 | Eaton | |
| 2014/0246184 | A1 | 9/2014 | Byman | |
| 2017/0210059 | A1 | 7/2017 | Pionetti | |
| 2022/0196343 | A1 | 6/2022 | Lawless | |

FOREIGN PATENT DOCUMENTS

| | | |
|---|---|---|
| CN | 204963606 | 1/2016 |
| CN | 207456244 | 6/2018 |
| CN | 208635603 | 3/2019 |

(Continued)

*Primary Examiner* — Eric S Ruppert

(74) *Attorney, Agent, or Firm* — Dennis D. Brown; Brown Patent Law, P.L.L.C.

(57) ABSTRACT

A plate-type heat exchanger and methods of construction and use wherein one or more separate, individual heat exchanging plate elements, through which a heat exchange fluid flows, are used which can (a) withstand pressure surge events, (b) allow the exchanger and the plate elements to be easily cleaned and maintained, and (c) allow the plate elements to be individually and separately removed from the exchanger for cleaning or maintenance while the exchanger remains online and while any other plate elements in the heat exchanger continue to operate.

20 Claims, 13 Drawing Sheets

(56) References Cited

FOREIGN PATENT DOCUMENTS

| | | |
|---|---|---|
| CN | 208919732 | 5/2019 |
| CN | 111306973 | 6/2020 |
| CN | 211475171 | 11/2020 |
| GB | 2231395 | 2/1990 |
| JP | 2013508657 | 10/2010 |
| JP | 2012077378 | 4/2012 |
| WO | 1990010839 | 9/1990 |
| WO | 2012150271 | 11/2012 |
| WO | 2013094912 | 6/2013 |
| WO | 2013106240 | 7/2013 |
| WO | 2014062653 | 4/2014 |

* cited by examiner

HEAT EXCHANGER, PLATE ELEMENT THEREFOR, AND METHOD OF CONSTRUCTION

FIELD OF THE INVENTION

The present invention relates to plate-type heat exchangers, heat exchanger plates, and methods of construction and use.

BACKGROUND OF THE INVENTION

Plate heat exchangers are used in many applications. Plate heat exchangers typically comprise a series of numerous plates which are compressed together in a stacked arrangement so that a flow channel is formed between each pair of adjacent plates. When in use for exchanging heat between a first fluid (e.g., a warm fluid) and a second fluid (e.g., a cold fluid), the two fluids flow through the adjacent flow channels in an alternating manner such that, e.g., the first fluid flows downwardly through the first channel, the second fluid flows upwardly through the next channel, the first fluid flows downwardly through the next channel, the second fluid flows upwardly through the next channel, etc.

One application which is of interest for plate-type heat exchangers is water-to-water heat exchange. For example, water from a river, a lake, the ocean, or other outside source can be used to cool, or heat, a clean water stream circulating through, e.g., a heat pump or other heating or cooling system for a home or other building. However, while water-based heat exchange is exponentially more efficient that air, the cooling or heating water obtained from such outside sources is commonly of poor quality. Sediment, dirt, microorganisms, and other contaminants contained in the cooling or heating water obtained from outside sources can cause fouling, blockage, and deterioration. As a result, stacked plate exchangers must typically be removed and professionally cleaned and/or rehabilitated up to four times a year or more.

Corrugations, which will typically be formed in the surfaces of the stacked exchanger plates to create turbulence in the flow channels for increased heat transfer efficiency, also provide crevasses and edges in the plate surfaces which are ideal for hard mineral deposits to collect and solidify.

The necessary cleaning and maintenance of a plate-type heat exchanger will typically require a prolonged shutdown of the entire system, which affects business operations and profitability.

In addition, plate-type heat exchangers can also be susceptible to damage from water hammer events. The damage produced by a sudden overpressure event of this nature can require extensive and costly repairs, or can destroy the exchanger entirely. To withstand water hammer events and prevent catastrophic damage, the physical integrity and pressure resistance of the plate exchanger must be increased significantly. However, this adds to the cost of constructing the plate assembly and can reduce the heat transfer efficiency of the exchanger.

Further, the use of metallurgic welding to strengthen the plate assembly can make repairs more difficult or impossible. And, over time, the malforming caused by welding can result in cracks and structural weakening.

Consequently, a need exists for an improved plate-type heat exchanger system which is well suited for water-to-water heat exchange. The exchanger plate elements of the improved system will preferably be much less susceptible to fouling and much easier and simpler to maintain. The exchanger plates will also preferably be individually removable for cleaning or maintenance so that, in a multiple plate system, the remaining elements can remain online and in use. Moreover, the exchanger plates will preferably provide a high level of resistance to water hammer and other over pressure events without loss of heat transfer efficiency, without increased construction costs, and without welding. In addition, the improved plate heat exchanger will preferably (i) allow the use of water of generally any quality, including seawater, and (ii) be highly durable.

SUMMARY OF THE INVENTION

The present invention provides an improved plate heat exchanger assembly, an improved heat exchanging plate element for use in the assembly, and improved methods of construction and use which satisfy the needs and alleviate the problems discussed above. Water of generally any quality, even seawater, can be used as the heating or cooling medium in the inventive plate exchanger system. If more than one of the inventive heat exchanging plate elements is used in the exchanger assembly, and if needed for cleaning, maintenance, or other reasons, each individual heat exchanging plate element can be separately disconnected and lifted out of the plate exchanger system, without disconnecting the other plate elements and without taking the heat exchanger assembly out of operation.

The individual heat exchanging plate elements of the present invention also provide a high level of resistance to water hammer or other sudden overpressure events, without any loss of heat transfer efficiency, without increasing the cost of production, and without welding. In addition, the inventive plate elements are simple to take apart, clean, and maintain.

The inventive plate-type heat exchanger assembly also has a modular configuration which is well suited for rapid deployment and quick plug and play use at any type of site or facility which may be desired. Moreover, the inventive plate-type exchanger assembly is well suited for use in new or existing water source heat pump systems for HVAC or other heating and cooling purposes.

In one aspect, there is provided a heat exchanging plate element which preferably comprises: a first outer metal sheet; a second outer metal sheet; an inner flow channel frame structure between the first and the second outer metal sheets; a first gasket positioned between the inner flow channel frame structure and the first outer metal sheet; and a second gasket positioned between the inner flow channel frame structure and the second outer metal sheet.

The inner flow channel frame structure of the heat exchanging plate element preferable has a flat shape which includes (a) a surrounding perimeter which extends around the inner flow channel frame structure and (b) a plurality of elongate internal segments which extend from and are surrounded by the surrounding perimeter, the elongate internal segments operating as flow channel dividing structures to form a plurality of inner flow channels between the first outer metal sheet and the second outer metal sheet, the plurality of inner flow channels including at least an initial flow channel and a final flow channel.

The first gasket of the heat exchanging plate element preferably has a flat shape which corresponds to the flat shape of the inner flow channel frame structure and includes (i) a surrounding perimeter of the first gasket which is positioned between the surrounding perimeter of the inner flow channel frame structure and the first outer metal sheet and (ii) a plurality of elongate internal segments of the first gasket which extend from the surrounding perimeter of the first gasket and are positioned between each of the elongate internal segments of the inner flow channel frame structure and the first outer metal sheet.

The second gasket of the heat exchanging plate element preferably has a flat shape which corresponds to the flat shape of the inner flow channel frame structure and includes (i) a surrounding perimeter of the second gasket which is positioned between the surrounding perimeter of the inner flow channel frame structure and the second outer metal sheet and (ii) a plurality of elongate internal segments of the second gasket which extend from the surrounding perimeter of the second gasket and are positioned between each of the elongate internal segments of the inner flow channel frame structure and the second outer metal sheet.

The heat exchanging plate element also preferably comprises: (i) a first plurality of bolts which extend, in forward or reverse order, through the first outer metal sheet, the surrounding perimeter of the first gasket, the surrounding perimeter of the inner flow channel frame structure, the surrounding perimeter of the second gasket, and the second outer metal sheet and (ii) a second plurality of bolts which extend, in forward or reverse order, through the first outer metal sheet, the elongate internal segments of the first gasket, the elongate internal segments of the inner flow channel frame structure, the elongate internal segments of the second gasket, and the second outer metal sheet.

In the event of a pressure surge of a fluid in the heat exchanging plate element, the first gasket and the second gasket of the heat exchanging plate element preferably (i) permit an amount of the fluid to escape though the first gasket and the second gasket, for pressure relief, at the locations of the first plurality of bolts and/or the second plurality of bolts and then (ii) return to a water-tight state.

In another aspect, there is provided a heat exchanger which preferably comprises: (a) a tank configured for delivering a first fluid therethrough and (b) one or more heat exchanging plate elements of the type described above which is/are separately positionable in and removable from the tank, for delivering a second fluid through the one or more heat exchanging plate elements.

Further objects, features, and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Figure 1:
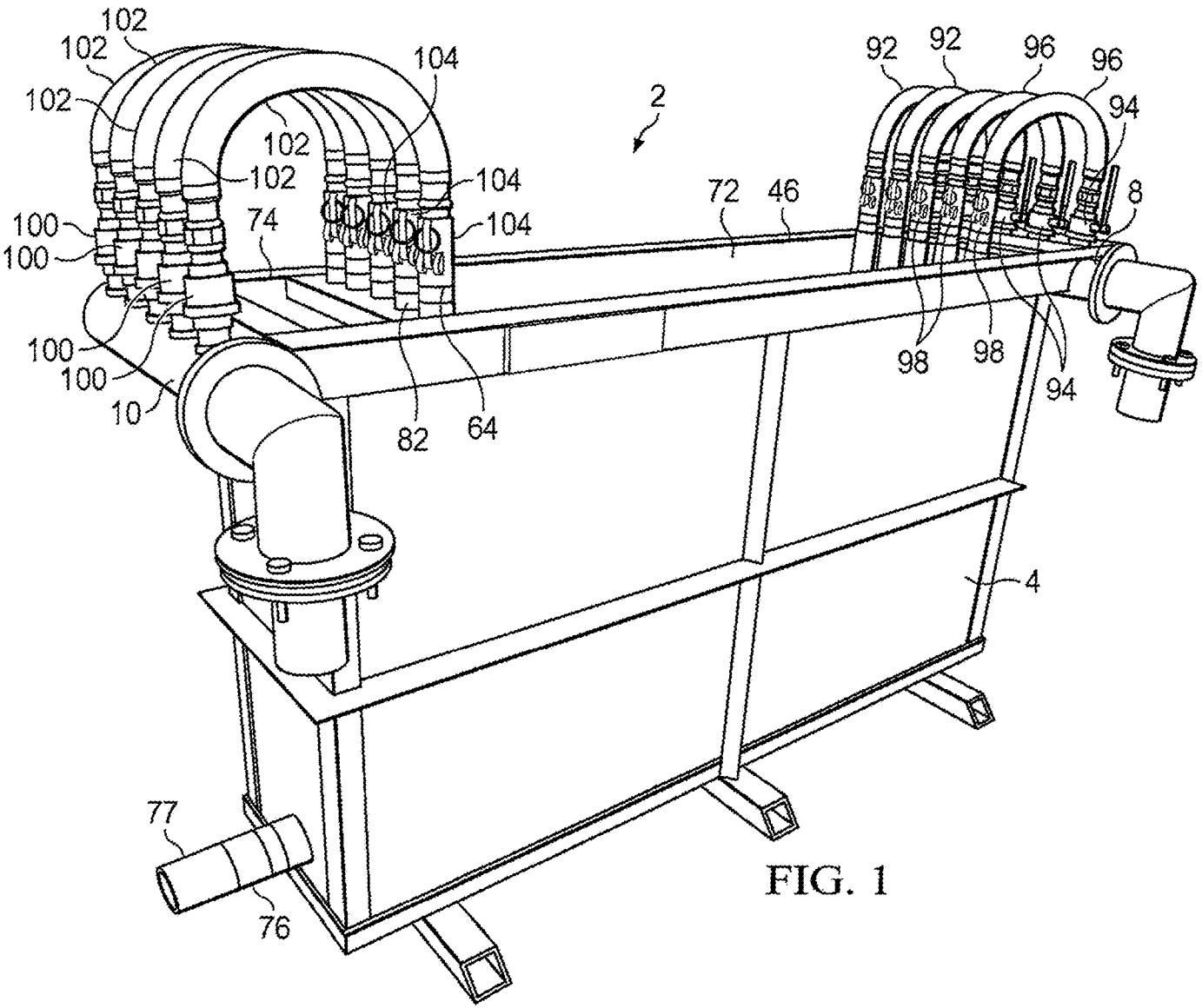
FIG. 1 is a perspective view of an embodiment 2 of the plate-type heat exchanger assembly provided by the present invention.
Figure 2:
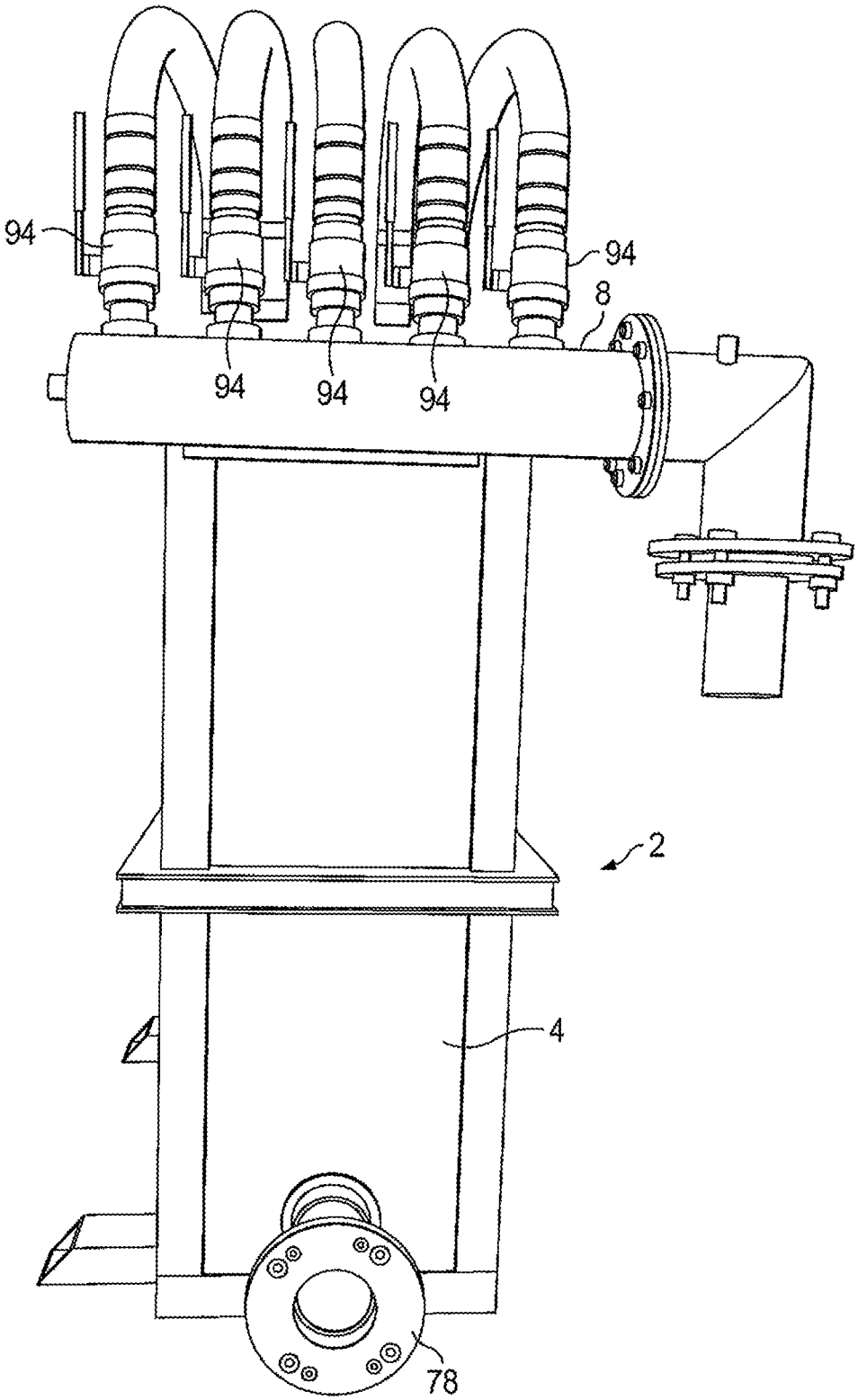
FIG. 2 is an elevational end view of the plate exchanger assembly 2.
Figure 3:
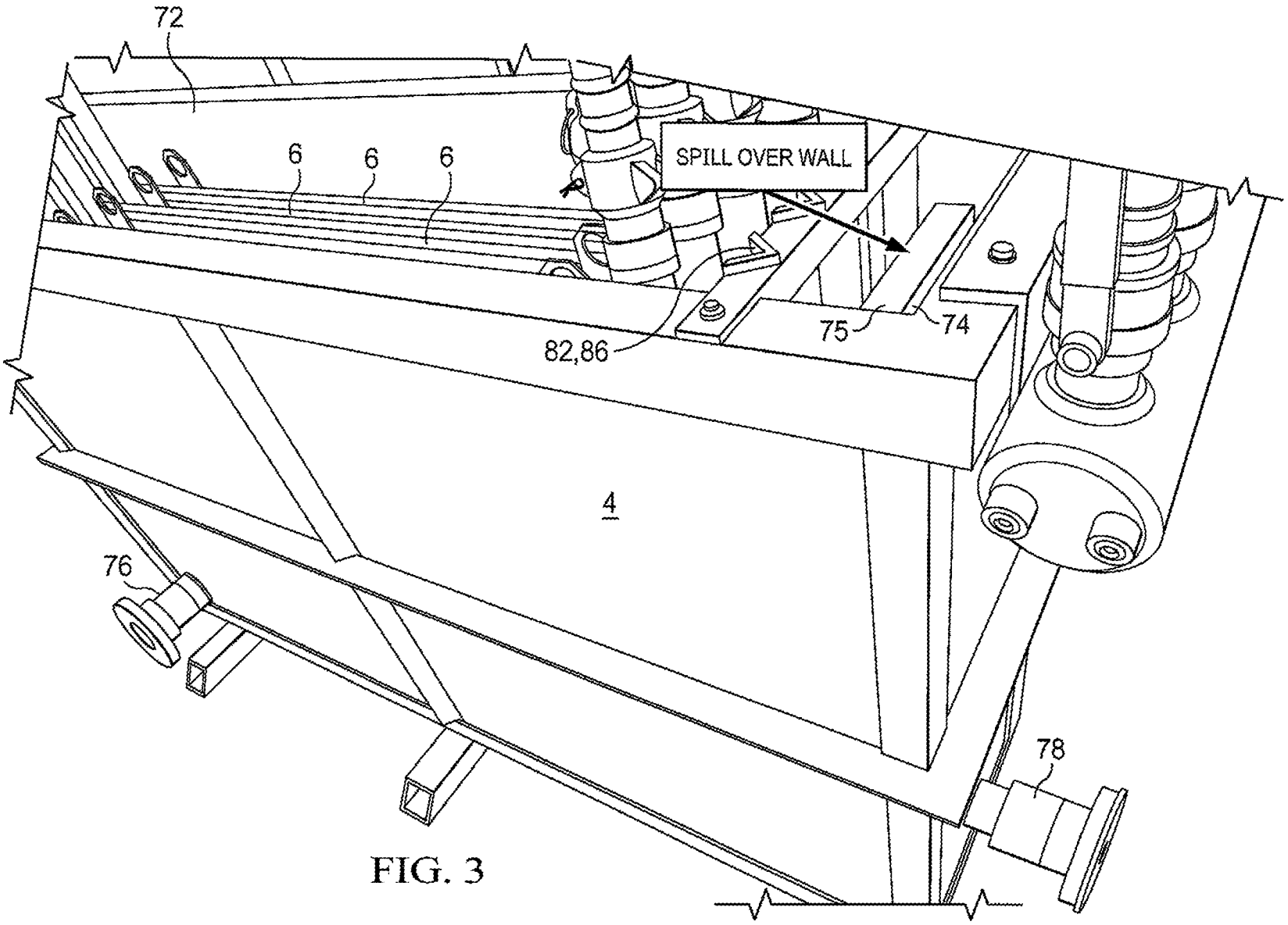
FIG. 3 is a top perspective view of the plate exchanger assembly 2.
Figure 4:
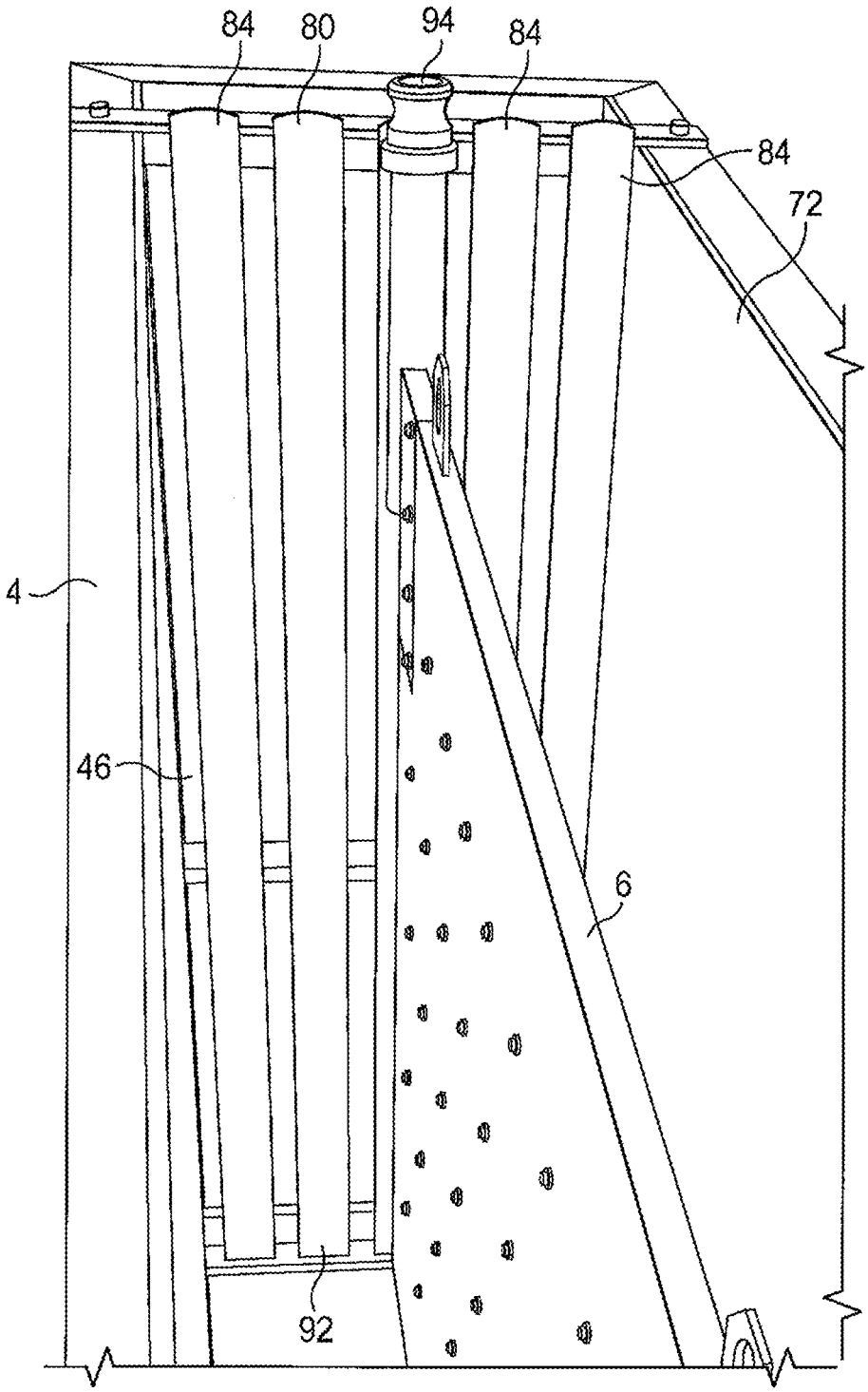
FIG. 4 is a partial top perspective view of the plate exchanger assembly 2.
Figure 5:
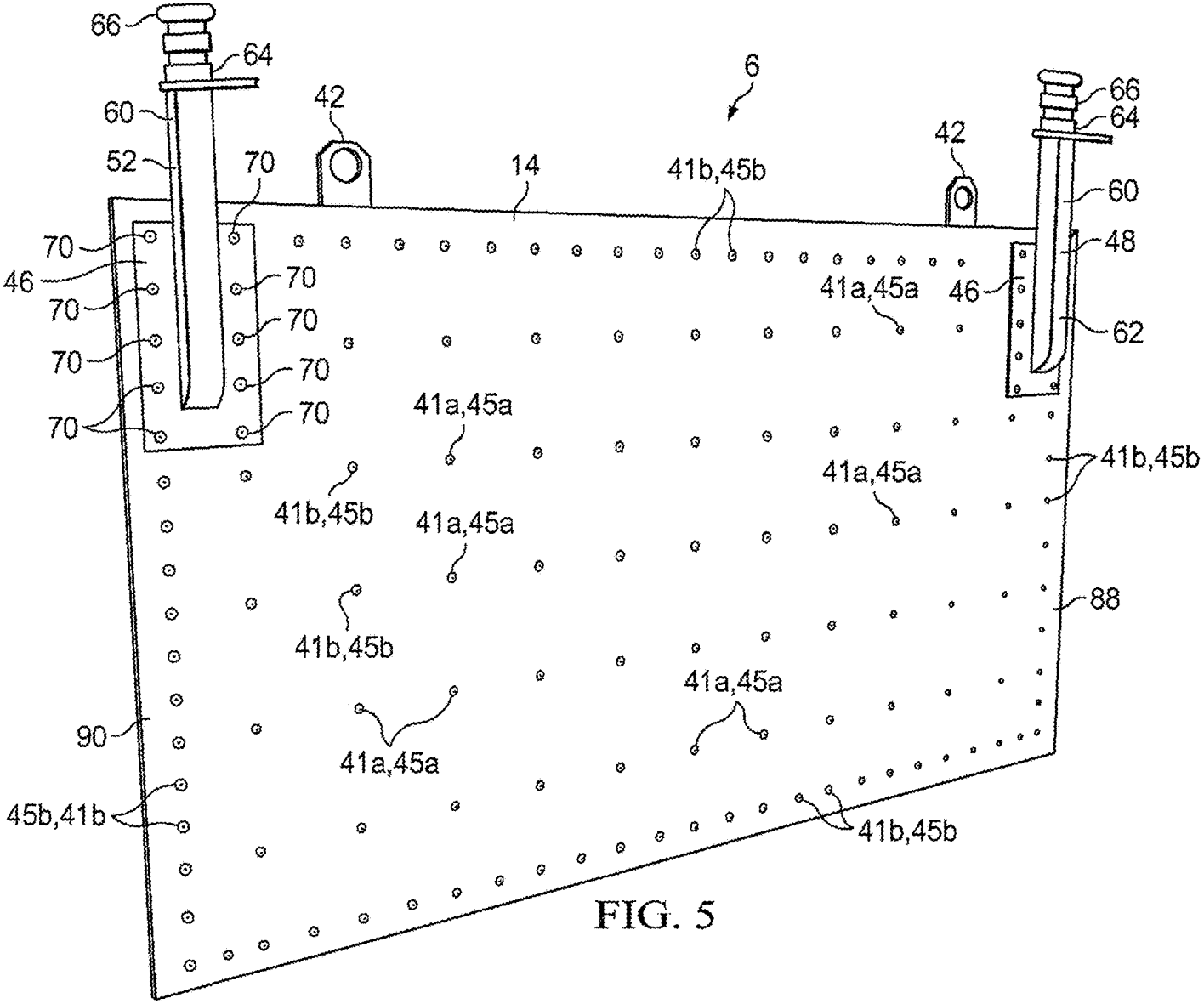
FIG. 5 is a front view of an embodiment 6 of a heat exchanging plate element which is provided by the present invention and used in the plate-type exchanger assembly 2.
Figure 6:
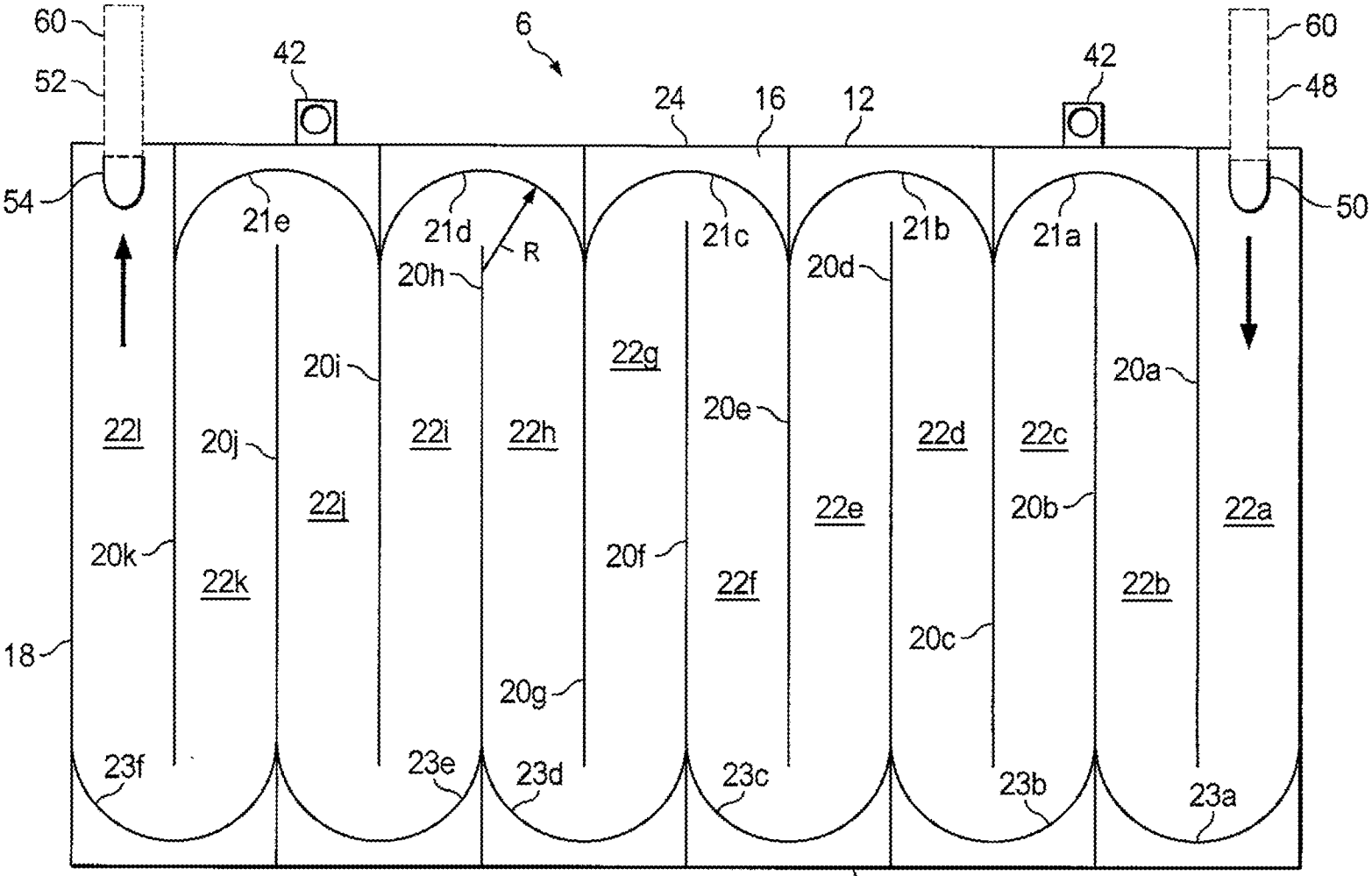
FIG. 6 is a schematic, cutaway, front elevational view of the heat exchanging plate element 6.
Figure 7:
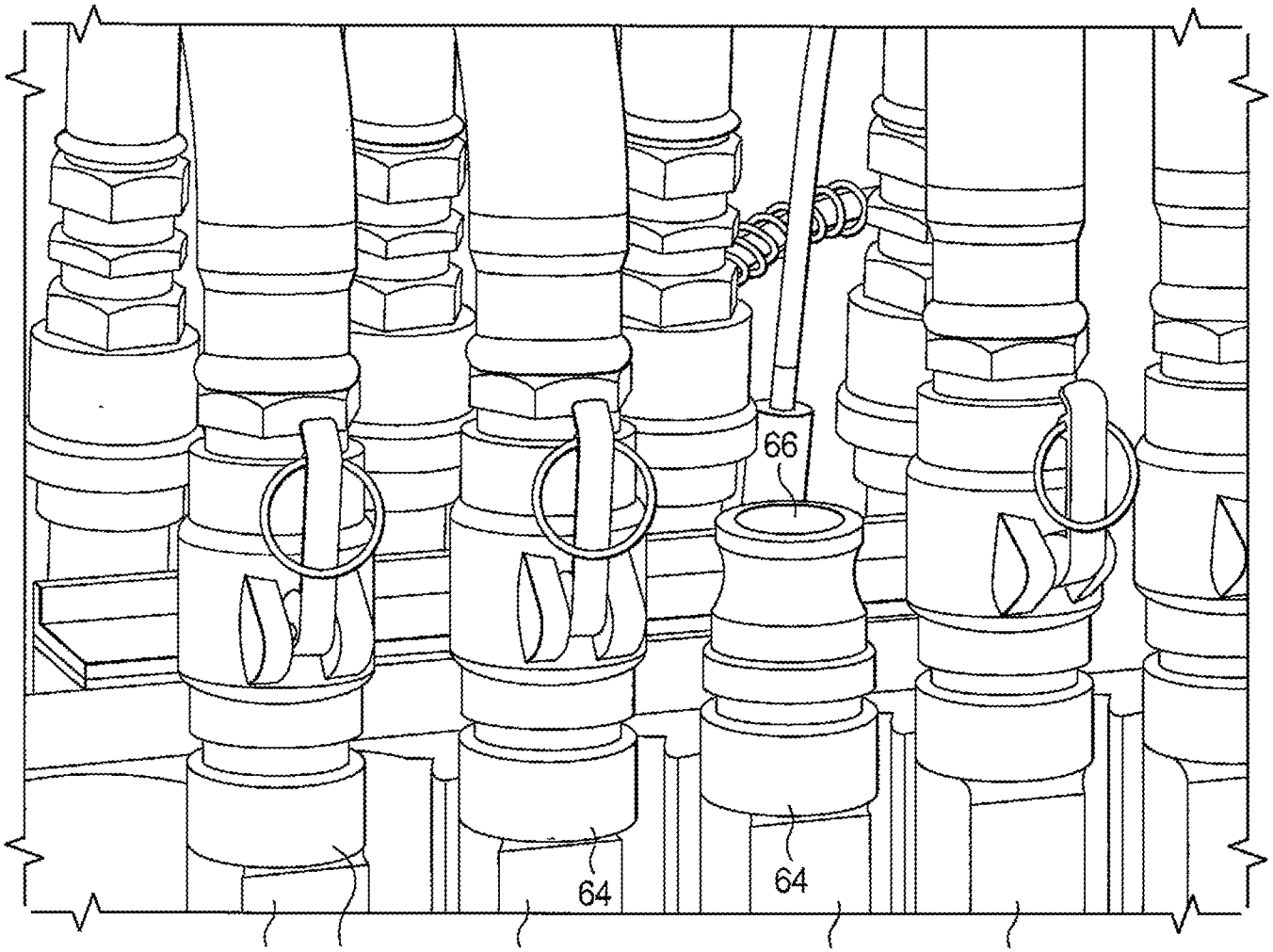
FIG. 7 is a partial discharge end view of the plate-type heat exchanger assembly 2.
Figure 8:
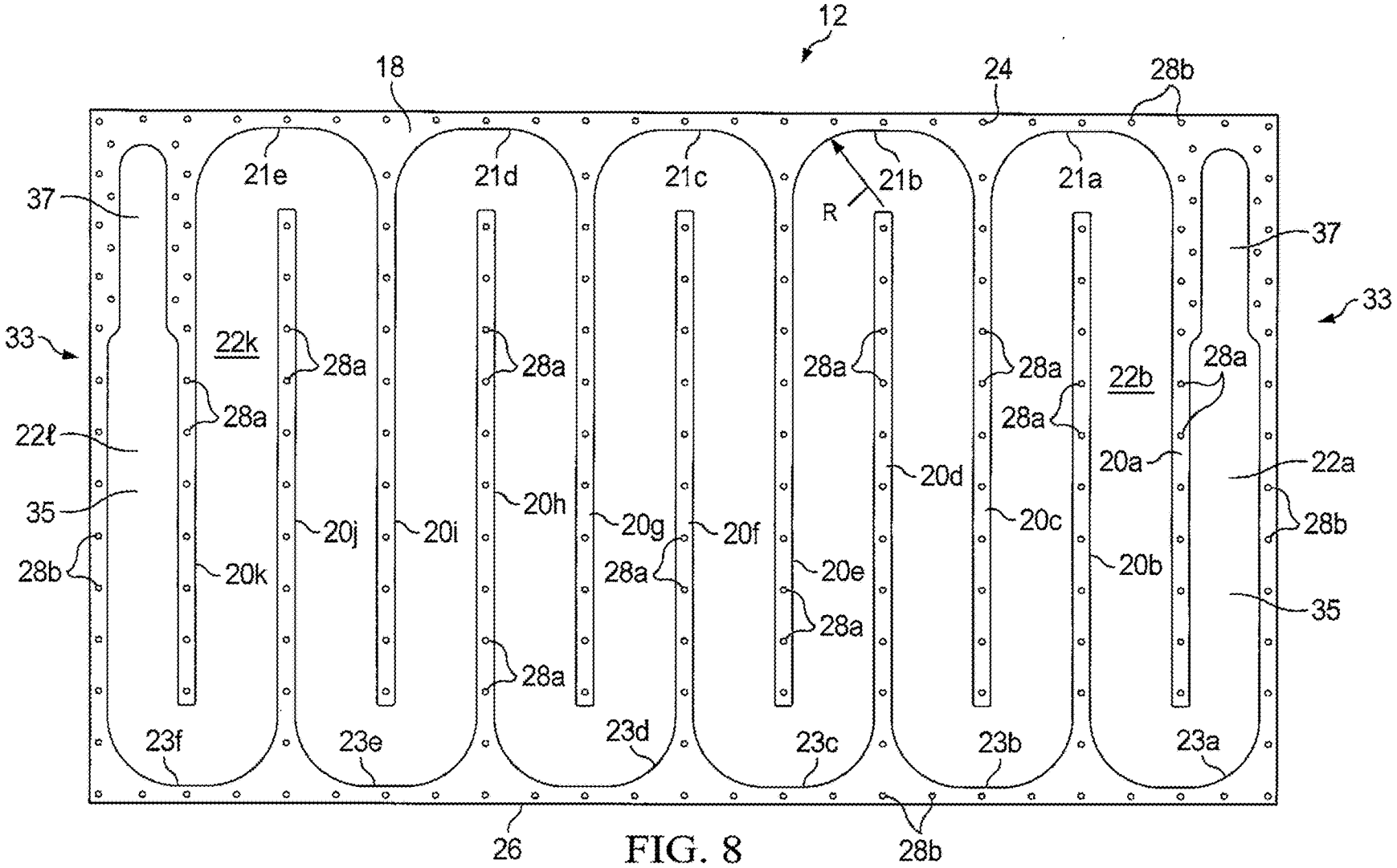
FIG. 8 is an elevational view of an inner flow channel dividing structure 12 used in the heat exchanging plate element 6.
Figure 9:
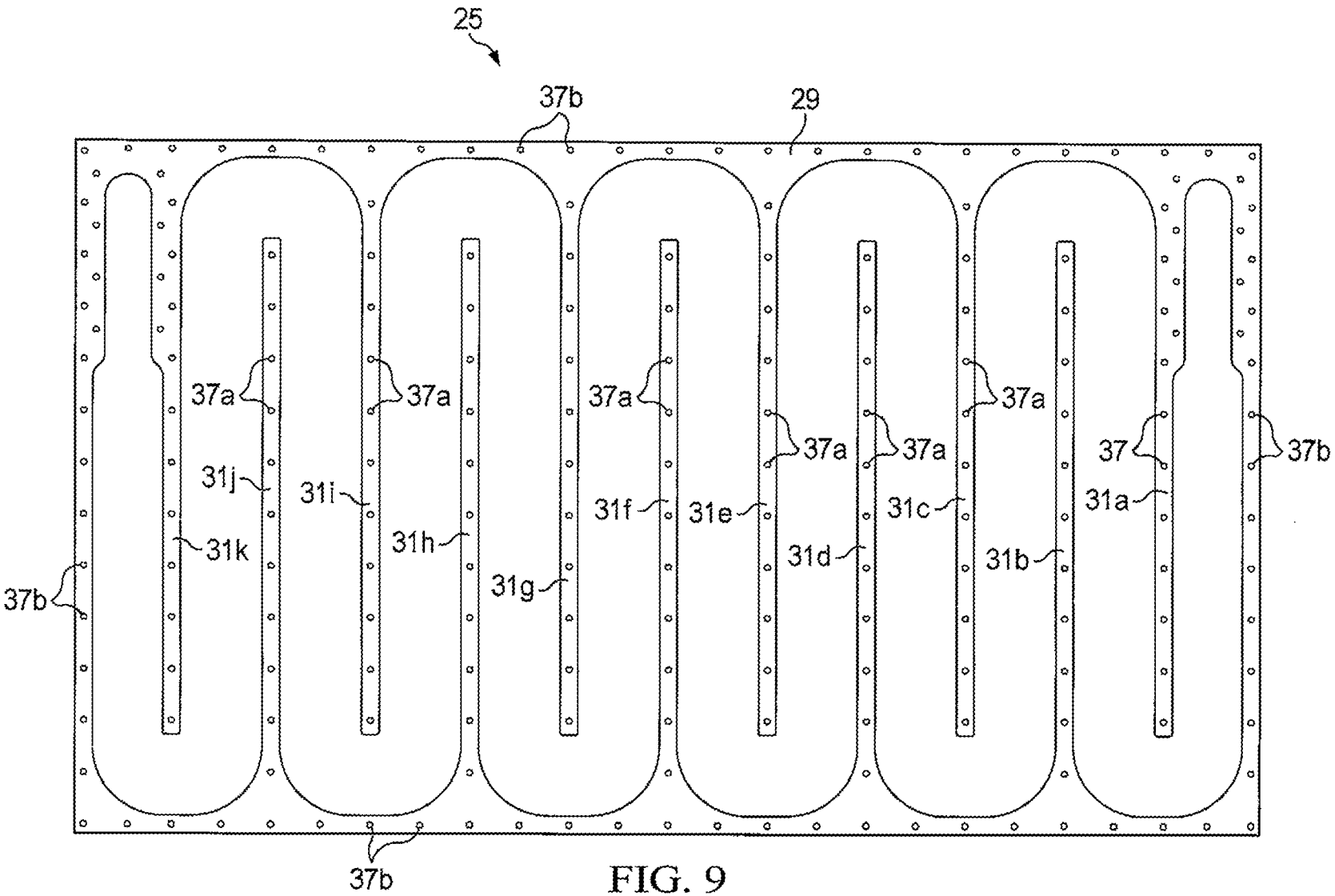
FIG. 9 is an elevational view of a first gasket 25 used in the heat exchanging plate element 6.
Figure 10:
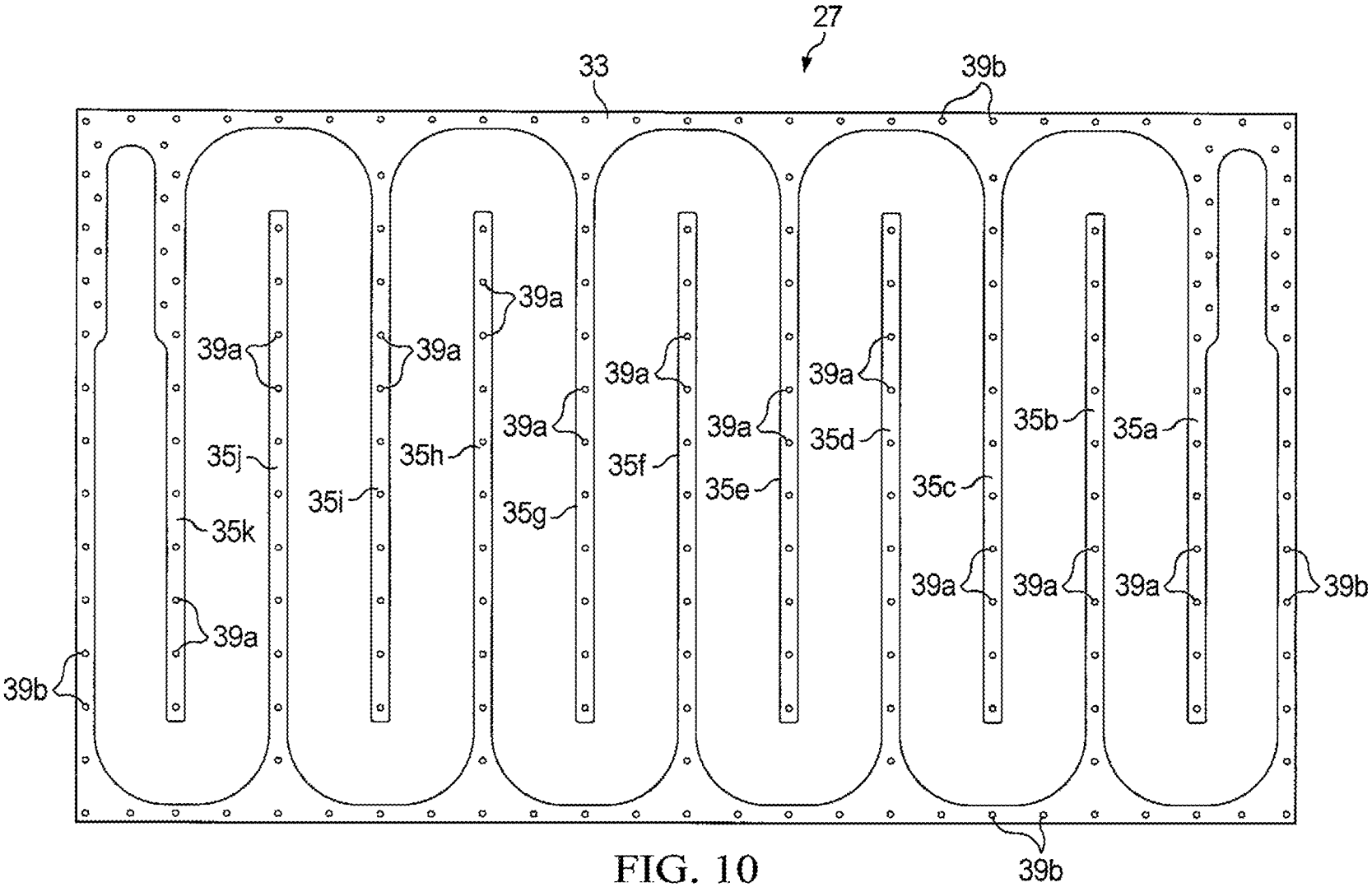
FIG. 10 is an elevational view of a second gasket 27 used in the heat exchanging plate element 6.
Figure 11:
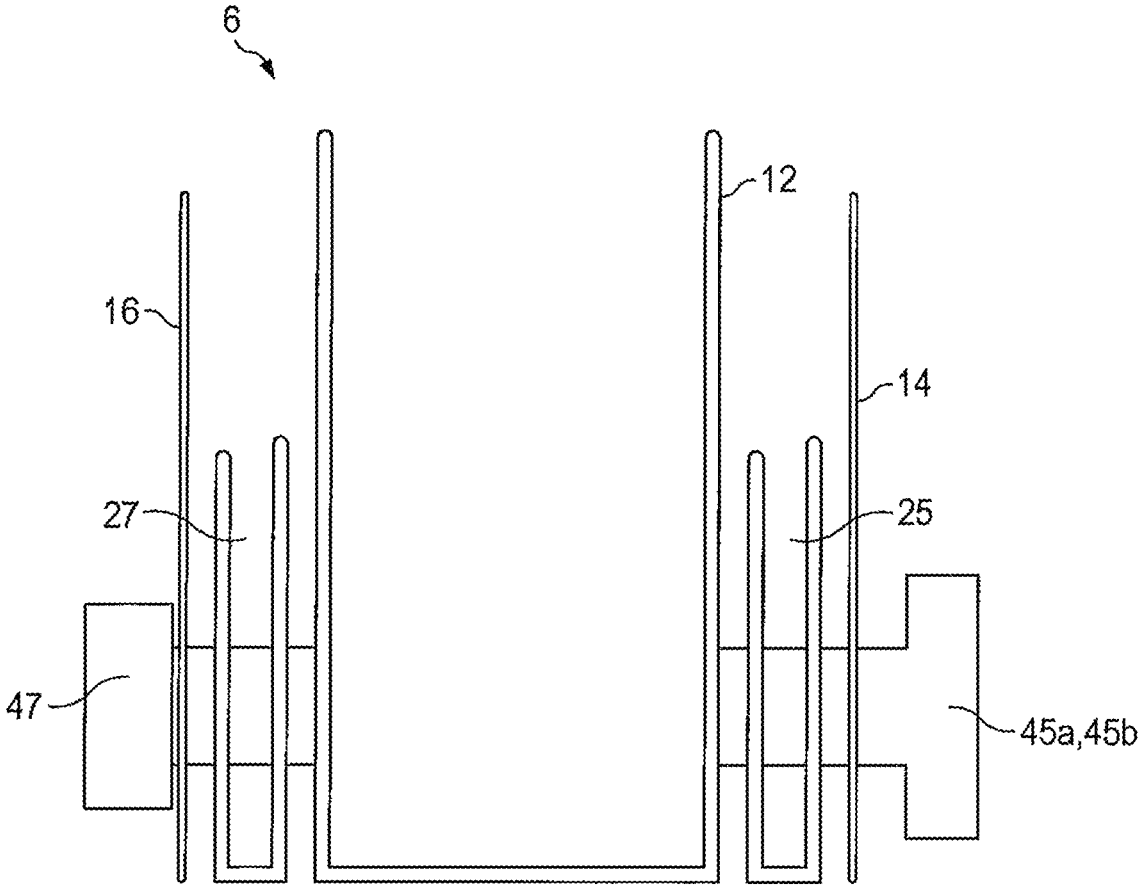
FIG. 11 schematically illustrates a partial cross-sectional view of the heat exchanging plate element 6.
Figure 12:
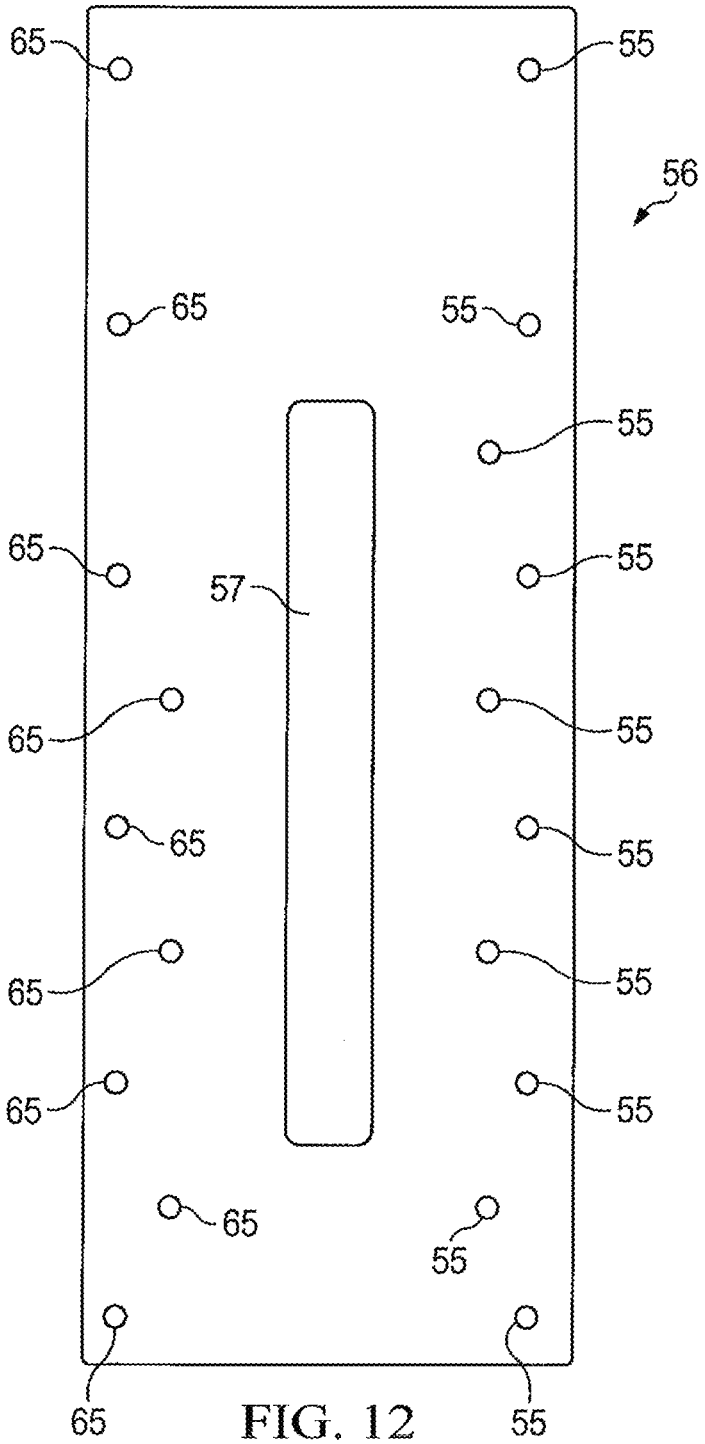
FIG. 12 is an elevational view of a flow connection face plate 56 used in the heat exchanging plate element 6.
Figure 13:
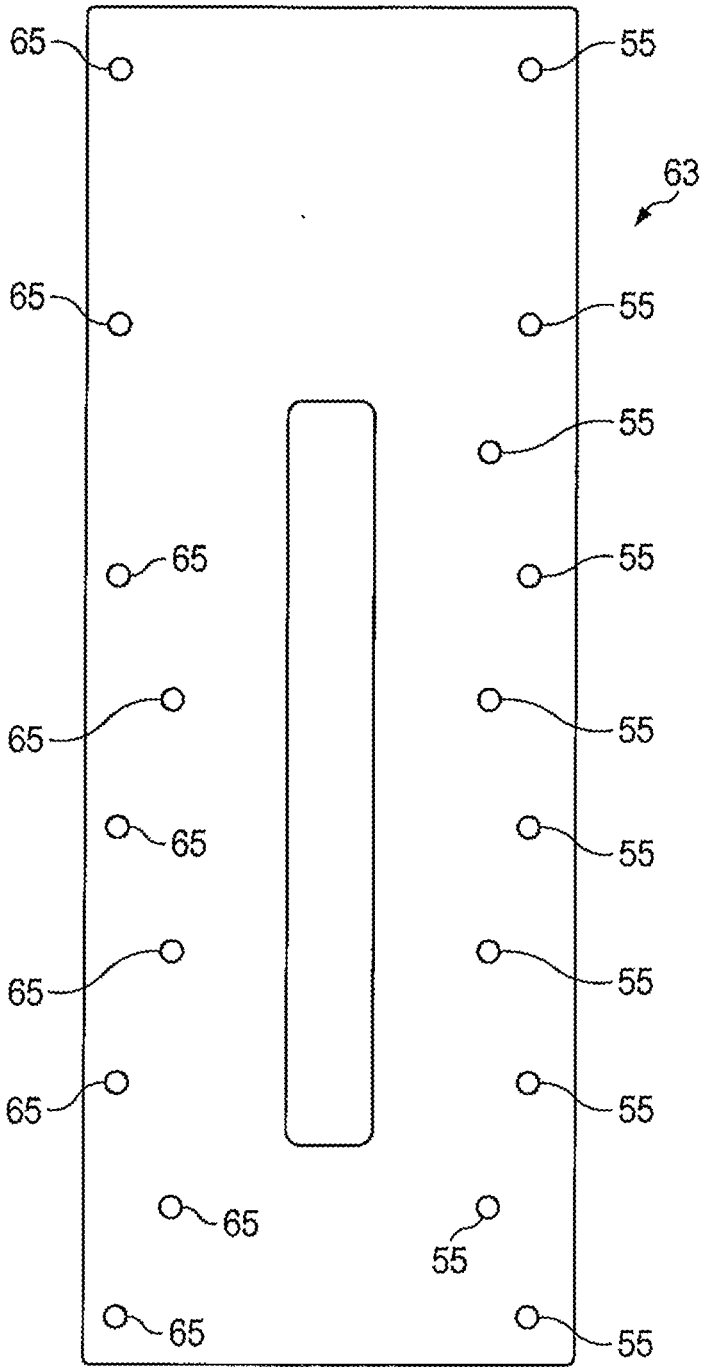
FIG. 13 is an elevational view of a flow connection gasket 63 used in the heat exchanging plate element 6.

An embodiment 2 of the plate-type heat exchanger assembly provided by the present invention is illustrated in FIGS. 2-4. The inventive heat exchanger assembly 2 preferably comprises: (i) a pass-through tank 4 through which a first fluid (e.g., heating or cooling water from a lake, a stream, the ocean, or other source) is delivered and (ii) one or more inventive heat exchanging plate elements 6 through which a second fluid (e.g., a recirculating clean water stream used in a heat pump system for condensing or evaporating a refrigerant) is delivered. Each of the heat exchanging plates 6 is separately and individually, and preferably vertically, positionable in and removable from the tank 4.

The inventive heat exchanger assembly 2 can also include (i) a supply manifold 8 attached to the tank 4 for receiving the second fluid and supplying the second fluid to the one or more plate elements 6 for heating or cooling and (ii) a discharge manifold 10 attached to the tank 4 for receiving the heated or cooled second fluid from the one or more heat exchanging plate elements 6 and discharging the second fluid to a heat pump assembly or other system. If used, the supply manifold 8 and the discharge manifold 10 are preferably attached to the tank 4 on the opposite ends and at or on the top ends of the end walls thereof.

Although the supply manifold 8 and the discharge manifold 10 can be included in the case of an inventive heat exchanger assembly 2 having only one or any number of heat exchanging plate elements 6, an embodiment of the inventive exchanger assembly 2 having a plurality of plate elements 6 will preferably include the supply and discharge manifolds 8 and 10 as shown but an embodiment having only one plate element 6 typically will not.

Each of the heat exchanging plate elements 6 preferably comprises an inner flow channel frame structure 12 which is positioned and sealed between a first outer metal sheet 14 and second outer metal sheet 16. The outer metal sheets 14 and 16 can be formed of any metal or alloy which is effective for heat transfer and is compatible with the fluids and conditions in the tank 4 and inside the plate elements 6. The outer metal sheets 14 and 16 are preferably identical rectangular metal sheets which are formed of aluminum (preferably 6061-T6 aluminum). The thicknesses of the outer sheets 14 and 16 will preferably each be in the range of from about 1/100 to about 9/16 inch and will more preferably be about 3/16 inch.

The inner flow channel frame structure 12 can be formed of any material which is compatible with the fluid and conditions within the heat exchanging plate element 6. Examples of such materials include, but are not limited to high density polyethylene, aluminum, and KEVLAR. The inner flow channel frame structure 12 will preferably be formed of high density polyethylene and will preferably have a thickness of about 3/8 inch.

As used herein and in the claims, the term "about" when used in reference to thicknesses or other dimensions means±10%.

The inner frame structure 12 is preferably a flat piece which comprises (a) a surrounding perimeter (preferably a continuous surrounding outer perimeter) 18 which preferably entirely surrounds the frame structure 12 and (b) a plurality of elongate internal linear segments 20*a-k* which extend from and are surrounded by the surrounding perimeter 18 of the inner flow channel frame structure 12. The internal linear segments 20*a-k* operate as flow channel dividing structures to form a plurality of inner flow channels 22*a-l* between the first outer metal sheet 14 and the second outer metal sheet 16.

The heat exchanging plate element 6 preferably comprises at least four and more preferably up to twelve or more of the inner flow channels 22*a-l*, including an initial flow channel 22*a* and a final flow channel 221.

For a rectangular inner frame structure 12 having a surrounding rectangular perimeter 18 which includes a horizontally extending upper frame segment 24 and a horizontally extending lower frame segment 26, the elongate flow channel dividing structures 20*a-k* will preferably comprise (i) linear internal segments 20*a*, 20*c*, 20*e*, 20*g*, 20*i*, and 20*k* which extend vertically downward from the upper horizontal frame segment 24 and have lower ends which are spaced apart from the lower horizontal frame segment 26 and (ii) linear internal segments 20*b*, 20*d*, 20*f*, 20*h*, and 20*j* which extend vertically upward from the lower horizontal frame segment 26 and have upper ends which are spaced apart from the upper horizontal frame segment 24. The downwardly extending channel dividing structures 20*a*, 20*c*, 20*e*, 20*g*, 20*i*, and 20*k* alternate with the upwardly extending channel dividing structures 20*b*, 20*d*, 20*f*, 20*h*, and 20*j* to form downwardly extending inner flow channels 22*a*, 22*c*, 22*e*, 22*g*, 22*i*, and 22*k* which alternate with upwardly extending inner flow channels 22*b*, 22*d*, 22*f*, 22*h*, 22*j*, and 22*l*.

In the horizontally extending upper segment 24 of the outer perimeter 18 of the inner frame structure 12, the transition 21*a*, 21*b*, 21*c*, 21*d*, 21*e* from the proximal end of each downwardly extending channel dividing segment 20*a*, 20*c*, 20*e*, 20*g*, 20*i* to the proximal end of the next succeeding downwardly extending channel dividing segment 20*c*, 20*e*, 20*g*, 20*i*, 20*k* is preferably rounded to reduce flow induced pressure within the heat exchanging plate element 6. For the same reason, in the horizontally extending lower segment 26 of the outer perimeter 18 of the inner frame structure 12, the transition 23*a*, 23*b*, 23*c*, 23*d*, 23*e*, 23*f* from the first vertical edge of the surrounding perimeter 18 or the proximal end of each upwardly extending channel dividing segment 20*b*, 20*d*, 20*f*, 20*h*, 20*j* to the proximal end of the next succeeding upwardly extending channel dividing segment 20*b*, 20*d*, 20*f*, 20*h*, 20*j* or the second vertical edge of the surrounding perimeter 18 is also preferably rounded. Each of the transitional segments 21*a*, 21*b*, 21*c*, 21*d*, and 21*e* in the horizontal upper piece 24 of the inner frame structure 12 and each of the lower transitional segments 23*a*, 23*b*, 23*c*, 23*d*, 23*e*, and 23*f* are preferably semicircular or near semicircular with a radius of curvature R in the range of from about 4.0 to about 4.5 inches. The radius of curvature R is more preferably about 4.3 inches.

To further reduce the internal pressure drop though the inventive heat exchanging plate element 6, as well as the peak pressures produced within the plate element 6, a flow transition profile 33 is preferably provided for both the first inner flow channel 22*a* and the final inner flow channel 221. The flow transition profile 33 of each the first and final inner flow channels 22*a* and 22*l* preferably comprises (a) a lower vertical flow portion 35 having a reduced width which is in the range of from about 75% to about 95% (more preferably from about 80% to about 90% or more preferably about 85.5%) of the width of each of the other inner flow channels 22*b*-22*k* and (b) an upper vertical flow portion 37, for the inflow or outflow of the second fluid, having a reduced width which is in the range of from about 60% to about 90% (more preferably from about 65% to about 75% and more preferably about 71.6%) of the width of the lower vertical portion 35 of the first or final inner flow channel 22*a* or 22*l*.

The flow transition profile 33 reduces the internal pressure drop into and out of the inventive heat exchanging plate element 6 by providing a more gradual transition between the round inlet and outlet feed tubes or hoses 96 and 102 for the plate element 6 and the flat internal flow channels 22*a*-221.

The inventive heat exchanging plate element 6 further comprises (i) a first gasket 25 positioned between the inner flow channel frame structure 12 and the first outer metal sheet 14 and (ii) a second gasket 27 positioned between the inner flow channel frame structure 12 and the second outer metal sheet 16. The first and second gaskets 25 and 27 are preferably identical to each other and also preferably have a shape which corresponds, and is most preferably identical, to the shape of the inner flow channel frame structure 12.

Consequently, the first gasket 25 preferably includes (i) a surrounding perimeter 29 which is positioned between the surrounding perimeter 18 of the inner flow channel frame structure 12 and the first outer metal sheet 14 and (ii) a plurality of elongate internal linear segments 31*a-k* which extend from and are surrounded by the surrounding perimeter 29 of the first gasket 25 and are positioned between each of the elongate internal segments 20*a-k* of the inner flow channel frame structure 12 and the first outer metal sheet 14.

In the same manner, the second gasket 27 preferably includes (i) a surrounding perimeter 33 which is positioned between the surrounding perimeter 18 of the inner flow channel frame structure 12 and the second outer metal sheet 16 and (ii) a plurality of elongate internal linear segments 35*a-k* which extend from and are surrounded by the surrounding perimeter 33 of the second gasket 25 and are positioned between each of the elongate internal segments 20*a-k* of the inner flow channel frame structure 12 and the second outer metal sheet 16.

For assembling each of the inventive heat exchanging plate elements 6, a series of pre-drilled or otherwise preformed holes 28*a* is preferably provided through each of the elongate flow channel dividing segments 20*a-k* of the inner frame structure 12. In addition, a surrounding series of pre-drilled or otherwise preformed holes 28*b* is preferably provided through the surrounding outer perimeter 18 of the inner frame structure 12.

The holes 28*a* and 28*b* of the inner frame structure 12 are in alignment with (i) corresponding holes 37*a* and 37*b* formed respectively through internal linear segments 31*a-k* and the surrounding perimeter 29 of the first gasket 25, (ii) corresponding holes 39*a* and 39*b* formed respectively through the internal linear segments 35*a-k* and the surrounding perimeter 33 of the second gasket 27, (iii) corresponding holes 41*a* and 41*b* formed through the first outer metal sheet 14, and (iv) corresponding holes formed through the second outer metal sheet 16.

Consequently, for securing the first gasket 25, the inner frame structure 12, and the second gasket 27 between the first and second outer metal sheets 14 and 16, bolts 45*a* and

45*b* are used wherein (a) bolts 45*a* are extended, in forward or reverse order, through the aligned holes 41*a* of the first outer metal sheet 14, 37*a* of the first gasket 25, 28*a* of the inner frame structure 12, 39*a* of the second gasket 27, and the corresponding holes of the second outer metal sheet 16 and (b) bolts 45*b* are extended, in forward or reverse order, through the aligned holes 41*b* of the first outer metal sheet, 37*b* of the surrounding perimeter 29 of the first gasket 25, 28*b* of the surrounding perimeter 18 of the inner frame structure 12, 39*b* of the surrounding perimeter 33 of the second gasket 27, and the corresponding holes of the second outer metal sheet 16.

The bolts 45*a* and 45*b* are preferably formed of stainless steel. The distal end of each of the bolts 45*a* and 45*b* is preferably threadedly received in a nyloc nut (a nylon insert lock nut) or other type of lock nut or nut 47.

The first and second gaskets 25 and 27 not only seal the inventive heat exchanging plate element 6 during normal operation, but also protect the inventive plate element 6 in the event of a surge in pressure of the fluid flowing through the plate element 6 (e.g., a water hammer event).

In the event of a pressure surge of the fluid in the heat exchanging plate element 6, the first gasket 25 and the second gasket 27 are sufficiently flexible to (i) permit an amount of the fluid in the plate element 6 to escape though the first gasket 25 and the second gasket 27, for pressure relief, at the locations of the bolts 45*a* and/or the bolts 45*b* and then (ii) return to a water-tight state.

The material used to form the first gasket 25 and the second gasket 27 can be any material which is effective for this purpose and is compatible with the fluid and conditions in the heat exchanging plate element 6. Examples of such materials include, but are not limited to neoprene, KEVLAR, and red rubber. The first and second gaskets 25 and 27 are preferably formed of neoprene and preferably have a thickness of about 1/16 inch.

Two or more, preferably a pair, of lifting lugs 42 are preferably bolted to, and extend upwardly from the horizontal top of, the heat exchanging plate element 6 for using a lift when independently lowering the plate element 6 through and independently hoisting the exchanging plate element 6 out of the open top 46 of the pass-through tank 4.

Each of the inventive heat exchanging plate elements 6 preferably also comprises: (a) an inlet flow connection 48 which is in fluid communication with the initial flow channel 22*a* via an inlet opening (preferably an elongate slot opening) which is formed through the first outer metal sheet 14 at or near the top of the initial flow channel 22*a* and (b) an outlet flow connection 52 which is in fluid communication with the final flow channel 221 via an outlet opening (preferably an elongate slot opening) which is formed through either the first or the second outer metal sheet 14 or 16 at or near the top of the final flow channel 221. The inlet and outlet flow connections 48 and 52 are preferably identical and are preferably both installed on the same side 14 of the plate element 6.

The inlet flow connection 48 and the outlet flow connection 52 preferably each comprise: (i) a face plate 56 having an opening 57 therethrough which matches the size and the shape of the inlet opening of the initial flow channel 22*a* or the outlet opening of the final flow channel 221; (ii) a conduit 60 having a proximal end portion 62 which is welded along the face plate 56 over and in fluid communication with the face plate opening; (iii) a flow connection gasket 63 positioned between the face plate 56 of the flow connection and the first outer metal sheet 14 or the second outer metal sheet 16; two vertically extending rows of holes 55 and 65 formed through the face plate 56 and the flow connection gasket 63 on opposite sides of the conduit 60; and a threaded connection 64 provided on the distal end of the conduit 60 for threadedly securing a male cam fitting 66 on the end of the conduit 60.

The inlet flow connection 48 and the outlet flow connection 52 each also preferably comprise a plurality of bolts 70 which extend, in forward or reverse order for the inlet connection 48, and in the same or any other order for the outlet connection 52, through the face plate 56, the flow connection gasket 63, the first outer metal sheet 14, the first gasket 25, the inner flow channel frame structure 12, the second gasket 27, and the second outer metal sheet 16.

The pass-through tank 4 of the inventive plate-type heat exchanger assembly 2 preferably comprises an internal spill-over wall 75 which extends upwardly from the bottom of the tank 4 and divides the interior of the tank 4 into (i) a heat transfer compartment 72 in which one or more, preferably a plurality, of the heat exchanging plate elements 6 are vertically received and (ii) a spill-over compartment 74. The spill-over wall 75 maintains a level of the water or other tank fluid supplied to the tank 4 which is at or near the tops of the heat exchanging plate elements 6, and also ensures that this fluid level is always present in the heat transfer compartment 72 (i.e., ensures that the heat transfer compartment is not unintentionally emptied), even if the flow of the tank fluid is lost.

The tank 4 further comprises: a tank inlet connection 76 which is positioned at or near the bottom of the tank 4 at or near the end of the heat transfer compartment 72 which is opposite the spill-over wall 75; a tank outlet connection 78 which is positioned at or near the bottom of the spill-over compartment 74; and two opposing removable guide rail structures 80 and 82 which are positioned in the heat transfer compartment 72 near the opposing longitudinal ends thereof.

The opposing guide rail structures 80 and 82 provide opposing pairs of vertical slots 84 and 86 for (a) individually receiving and guiding the vertical side edges 88 and 90 of the rectangular plate elements 6 as they are separately lowered through the top opening 46 of the tank 4 into the heat transfer compartment 72 and (b) holding the plate elements 6 in vertical, spaced, side-by-side positions in the heat transfer compartment to allow the water or other fluid in the tank to flow between the plate elements 6. The guide rail structures 80 and 82 also have closed bottom ends 92 which are spaced above the bottom of the tank 4 for holding the heat exchanging plate elements 6 in suspension to further facilitate the flow of the fluid in the heat transfer compartment 72 and to keep the lower ends of the plate assemblies 6 out of any sediment which might collect in the bottom of the tank 4.

All of the interior metal surfaces and the interior welded seams of the tank 4 are preferably coated with a coal tar epoxy primer or other suitable primer material and then coated with an epoxy sealant, such as, e.g., Marine Adhesive Sealant 5200 available from 3M Company, to prevent the water or other fluid in the tank from contacting the interior surfaces and welds. In addition, the metal inlet and outlet connections 74 and 76 of the tank 4 preferably have non-metallic liners 77 extending therethrough which protect the metal tank connections 74 and 76 from being contacted by the tank fluid. The non-metallic liners 77 for the tank connections 74 and 76 are preferably formed of polyethylene or fiberglass and are more preferably formed of polyethylene.

The inventive plate-type heat exchanger assembly 2 and the inventive heat exchanging plate elements 6 used therein allow the individual plate elements 6 to be separately removed from and returned to the pass-through tank 4 for cleaning, maintenance, or any other purpose such that, if the inventive plate exchanger assembly 2 has a plurality of heat exchanging plate elements 6, the inventive exchanger assembly 2 can remain on-line and the remaining plate elements 6 can continue to operate when any one or more of the plate elements 6 has or have been removed.

To allow each of the heat exchanging plate elements 6 to be individually isolated, removed, and returned in this manner, the inventive heat exchanger assembly 2 preferably further comprises for each of the plate elements 6: (i) a separate supply shut-off valve 94 (at the supply manifold 8 if a supply manifold 8 is used); (ii) a flexible supply conduit (preferably a braided stainless steel hose) 96 which extends from the supply shut-off valve 94; (iii) a quick connect connector 98 (preferably a female camlock fitting for receiving the male cam fitting 66 of the inlet flow connection 48 of the plate element 6) provided on the distal end of flexible supply conduit 96; (iv) a separate discharge shut-off valve 100 (at the discharge manifold 10 if a discharge manifold 10 is used); (v) a flexible discharge conduit (preferably a braided stainless steel hose) 102 which extends from the discharge shut-off valve 100; and (vi) a quick connect connector 104 (preferably a female camlock fitting for receiving the male cam fitting 66 of the outlet flow connection 52 of the plate element 6) provided on the distal end of flexible discharge conduit 102.

To take one of the heat exchanging plate elements 6 offline for cleaning or maintenance, the supply shut-off valve 94 and the discharge shut-off valve 100 for the plate element are closed, the quick connect connectors 98 and 104 for the flexible supply and discharge conduits 96 and 102 are released from the plate inlet and outlet flow connections 48 and 52, and the lifting lugs 42 of the plate element 6 are used to lift the plate element 6 out of the tank 4. To then return the removed plate element 6 to operation, the lifting lugs 42 are used to lower the plate element 6 into the tank 4, the quick connect connectors 98 and 104 on the supply and discharge conduits 96 and 102 are reconnected to the inlet and outlet flow connections 48 and 52 of the plate 6, and the supply and discharge shut-off valves 94 and 100 are opened.

The inventive heat exchanging plate element 6 has a smooth design with minimal right angles and edges to enable quick and easy cleaning. When using water of substantially any quality in the tank 4, the exterior of the inventive plate element 6 can be cleaned with a nylon bristle brush using DAWN dishwashing liquid or other cleaner such as SIMPLE GREEN. When the fluid delivered through the plate element 6 is clean potable water, the inner flow channels 22*a-l* of the plate assembly 6 can be cleaned by simply flushing the interior of the plate element 6 with clean water and/or a vinegar and baking soda solution.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within this invention as defined by the claims.

What is claimed is:

1. A heat exchanger comprising:

a tank configured for delivering a first fluid therethrough and one or more heat exchanging plate elements, separately positionable in and removable from the tank, for delivering a second fluid through the one or more heat exchanging plate elements, each of the one or more heat exchanging plate elements comprising:

a first outer metal sheet, a second outer metal sheet, an inner flow channel frame structure between the first and the second outer metal sheets, the inner flow channel frame structure having a flat shape which includes (a) a surrounding perimeter which extends around the inner flow channel frame structure and (b) a plurality of elongate internal segments which extend from and are surrounded by the surrounding perimeter, the elongate internal segments operating as flow channel dividing structures to form a plurality of inner flow channels between the first outer metal sheet and the second outer metal sheet, the plurality of inner flow channels including at least an initial flow channel and a final flow channel, a first gasket positioned between the inner flow channel frame structure and the first outer metal sheet, the first gasket having a flat shape which corresponds to the flat shape of the inner flow channel frame structure and includes (i) a surrounding perimeter of the first gasket which is positioned between the surrounding perimeter of the inner flow channel frame structure and the first outer metal sheet and (ii) a plurality of elongate internal segments of the first gasket which extend from the surrounding perimeter of the first gasket and are positioned between each of the elongate internal segments of the inner flow channel frame structure and the first outer metal sheet, a second gasket positioned between the inner flow channel frame structure and the second outer metal sheet, the second gasket having a flat shape which corresponds to the flat shape of the inner flow channel frame structure and includes (i) a surrounding perimeter of the second gasket which is positioned between the surrounding perimeter of the inner flow channel frame structure and the second outer metal sheet and (ii) a plurality of elongate internal segments of the second gasket which extend from the surrounding perimeter of the second gasket and are positioned between each of the elongate internal segments of the inner flow channel frame structure and the second outer metal sheet, a first plurality of bolts extending in forward or reverse order through the first outer metal sheet, the surrounding perimeter of the first gasket, the surrounding perimeter of the inner flow channel frame structure, the surrounding perimeter of the second gasket, and the second outer metal sheet, a second plurality of bolts extending in forward or reverse order through the first outer metal sheet, the elongate internal segments of the first gasket, the elongate internal segments of the inner flow channel frame structure, the elongate internal segments of the second gasket, and the second outer metal sheet, and in the event of a pressure surge of the second fluid in the heat exchanging plate element, the first gasket and the second gasket (i) permit an amount of the second fluid to escape though the first gasket and the second gasket, for pressure relief, at the locations of the first plurality of bolts and/or the second plurality of bolts and then (ii) return to a water-tight state.

2. The heat exchanger of claim 1 further comprising the first gasket and the second gasket each being formed of neoprene.

3. The heat exchanger of claim 2 further comprising the first gasket and the second gasket each having a thickness of about 1/16 inch.

4. The heat exchanger of claim 1 further comprising the inner flow channel frame structure being formed of high density polyethylene.

5. The heat exchanger of claim 4 further comprising the inner flow channel frame structure having a thickness of about 3/8 inch.

6. The heat exchanger of claim 4 further comprising the first plurality of bolts and the second plurality of bolts being stainless steel bolts.

7. The heat exchanger of claim 6 further comprising each of the first plurality of bolts and each one of the second plurality of bolts being received in a nyloc nut.

8. The heat exchanger of claim 1 further comprising the first and the second outer metal sheets each being formed of aluminum.

9. The heat exchanger of claim 1 further comprising the heat exchanger having only one of the one or more heat exchanging plate elements.

10. The heat exchanger of claim 1 further comprising each of the one or more heat exchanging plate elements including:

an inlet flow connection in fluid communication with the initial flow channel via an inlet opening of the initial flow channel formed through the first outer metal sheet and an outlet flow connection in fluid communication with the final flow channel via an outlet opening of the final flow channel formed through the first or the second outer metal sheet.

11. The heat exchanger of claim 10 further comprising:

the inlet flow connection of each of the heat exchanging plate elements comprising a face plate having an opening therethrough which is positioned over the inlet opening of the initial flow channel, an inlet conduit which extends from, and is in fluid communication with the opening of, the face plate of the inlet flow connection, an inlet flow connection gasket positioned between the face plate of the inlet flow connection and the first outer metal sheet, and a plurality of bolts extending in forward or reverse order through the face plate of the inlet flow connection, the inlet flow connection gasket, the first outer metal sheet, the first gasket, the inner flow channel frame structure, the second gasket, and the second outer metal sheet and the outlet flow connection of each of the heat exchanging plate elements comprising a face plate having an opening therethrough which is positioned over the outlet opening of the final flow channel, an outlet conduit which extends from, and is in fluid communication with the opening of, the face plate of the outlet flow connection, an outlet flow connection gasket positioned between the face plate of the outlet flow connection and the first or second outer metal sheet, and a plurality of bolts extending in any order through the face plate of the outlet flow connection, the outlet flow connection gasket, the first outer metal sheet, the first gasket, the inner flow channel frame structure, the second gasket, and the second outer metal sheet.

12. A heat exchanging plate element comprising:

a first outer metal sheet;

a second outer metal sheet;

an inner flow channel frame structure between the first and the second outer metal sheets, the inner flow channel frame structure having a flat shape which includes (a) a surrounding perimeter which extends around the inner flow channel frame structure and (b) a plurality of elongate internal segments which extend from and are surrounded by the surrounding perimeter, the elongate internal segments operating as flow channel dividing structures to form a plurality of inner flow channels between the first outer metal sheet and the second outer metal sheet, the plurality of inner flow channels including at least an initial flow channel and a final flow channel;

a first gasket positioned between the inner flow channel frame structure and the first outer metal sheet, the first gasket having a flat shape which corresponds to the flat shape of the inner flow channel frame structure and includes (i) a surrounding perimeter of the first gasket which is positioned between the surrounding perimeter of the inner flow channel frame structure and the first outer metal sheet and (ii) a plurality of elongate internal segments of the first gasket which extend from the surrounding perimeter of the first gasket and are positioned between each of the elongate internal segments of the inner flow channel frame structure and the first outer metal sheet;

a second gasket positioned between the inner flow channel frame structure and the second outer metal sheet, the second gasket having a flat shape which corresponds to the flat shape of the inner flow channel frame structure and includes (i) a surrounding perimeter of the second gasket which is positioned between the surrounding perimeter of the inner flow channel frame structure and the second outer metal sheet and (ii) a plurality of elongate internal segments of the second gasket which extend from the surrounding perimeter of the second gasket and are positioned between each of the elongate internal segments of the inner flow channel frame structure and the second outer metal sheet;

a first plurality of bolts extending in forward or reverse order through the first outer metal sheet, the surrounding perimeter of the first gasket, the surrounding perimeter of the inner flow channel frame structure, the surrounding perimeter of the second gasket, and the second outer metal sheet;

a second plurality of bolts extending in forward or reverse order through the first outer metal sheet, the elongate internal segments of the first gasket, the elongate internal segments of the inner flow channel frame structure, the elongate internal segments of the second gasket, and the second outer metal sheet; and in the event of a pressure surge of a fluid in the heat exchanging plate element, the first gasket and the second gasket (i) permit an amount of the fluid to escape though the first gasket and the second gasket, for pressure relief, at the locations of the first plurality of bolts and/or the second plurality of bolts and then (ii) return to a water-tight state.

13. The heat exchanging plate element of claim 12 further comprising the first gasket and the second gasket each being formed of neoprene.

14. The heat exchanging plate element of claim 13 further comprising the first gasket and the second gasket each having a thickness of about 1/16 inch.

15. The heat exchanging plate element of claim 12 further comprising the inner flow channel frame structure being formed of high density polyethylene.

16. The heat exchanging plate element of claim 15 further comprising the inner flow channel frame structure having a thickness of about 3/8 inch.

17. The heat exchanging plate element of claim 15 further comprising each one of the first plurality of bolts and each one of the second plurality of bolts being a stainless steel bolt.

18. The heat exchanging plate element of claim 17 further comprising each one of the first plurality of bolts and each one of the second plurality of bolts being received in a nyloc nut.

19. The heat exchanging plate element of claim 12 further comprising the first and the second outer metal sheets each being formed of aluminum.

20. The heat exchanging plate element of claim 12 further comprising:

an inlet flow connection in fluid communication with the initial flow channel via an inlet opening of the initial flow channel formed through the first outer metal sheet;

the inlet flow connection comprising a face plate having an opening therethrough which is positioned over the inlet opening of the initial flow channel, an inlet conduit which extends from, and is in fluid communication with the opening of, the face plate of the inlet flow connection, an inlet flow connection gasket positioned between the face plate of the inlet flow connection and the first outer metal sheet, and a plurality of bolts extending in forward or reverse order through the face plate of the inlet flow connection, the inlet flow connection gasket, the first outer metal sheet, the first gasket, the inner flow channel frame structure, the second gasket, and the second outer metal sheet;

an outlet flow connection in fluid communication with the final flow channel via an outlet opening of the final flow channel formed through the first or the second outer metal sheet; and the outlet flow connection comprising a face plate having an opening therethrough which is positioned over the outlet opening of the final flow channel, an outlet conduit which extends from, and is in fluid communication with the opening of, the face plate of the outlet flow connection, an outlet flow connection gasket positioned between the face plate of the outlet flow connection and the first or the second outer metal sheet; and a plurality of bolts extending, in any order, through the face plate of the outlet flow connection, the outlet flow connection gasket, the first outer metal sheet, the first gasket, the inner flow channel frame structure, the second gasket, and the second outer metal sheet.

* * * * *